US006971325B1

(12) United States Patent
Inaba

(10) Patent No.: US 6,971,325 B1
(45) Date of Patent: Dec. 6, 2005

(54) METHOD FOR MENDING AN EMBROIDERY PATTERN

(75) Inventor: Tomoyuki Inaba, Ichinomiya (JP)

(73) Assignee: Kabushikikaisha Barudan, Aichi-ken (JP)

( * ) Notice: Subject to any disclaimer, the term of this patent is extended or adjusted under 35 U.S.C. 154(b) by 0 days.

(21) Appl. No.: 11/159,549

(22) Filed: Jun. 22, 2005

(30) Foreign Application Priority Data

Jul. 26, 2004 (JP) ..... 2004-218008
Feb. 16, 2005 (JP) ..... 2005-039448

(51) Int. Cl.[7] ..... D05B 3/12; D05C 5/02; D05C 7/00; D05C 9/04

(52) U.S. Cl. ..... 112/475.19

(58) Field of Search ..... 112/475.19, 475.18, 112/102.5, 317, 470.06, 113; 700/138

(56) References Cited

U.S. PATENT DOCUMENTS 5,755,168 A * 5/1998 Gunther et al. ..... 112/113
6,123,037 A * 9/2000 Shimizu ..... 112/102.5

FOREIGN PATENT DOCUMENTS

DE 92 09 764.2 10/1992
JP 02-144094 6/1990

OTHER PUBLICATIONS

Patent Abstracts of Japan for JP02-144094 published Jun. 1, 1990.

* cited by examiner

*Primary Examiner*—Peter Nerbun
(74) *Attorney, Agent, or Firm*—Darby & Darby

(57) ABSTRACT

A method for mending an embroidery pattern sewn on an embroidery machine controlled based on a sewing data, having the steps of determining if a sequin is dropped from the embroidery pattern. If the sequin is dropped, stopping the embroidery machine and retrieving a control signal with a supply command for the sequin from the sewing data. An embroidery frame of the embroidery machine is returned to a position prior to the retrieved control signal. The embroidery machine is restarted and a new sequin is sewn onto the dropped part of the embroidery pattern.

10 Claims, 6 Drawing Sheets

THREAD BREAKAGE

MACHINE STOP

MENDING SWITCH ON

MENDING SWITCH ON

MACHINE RESTART

METHOD FOR MENDING AN EMBROIDERY PATTERN

INCORPORATION BY REFERENCE

The present application claims priority under 35 U.S.C. §119 to Japanese Patent Application Nos. 2004-218008 filed on Jul. 26, 2004 and 2005-039448 filed on Feb. 16, 2005. The contents of these applications are incorporated herein by reference in their entireties.

TECHNICAL FIELD

The present invention relates to a method for mending an embroidery pattern when a sequin is dropped during sequin embroidery by an embroidery machine.

BACKGROUND OF THE INVENTION

In the prior art, there are known techniques for making embroidery patterns with sequins (also called spangles) for ornamentation using an embroidery machine. For example, in West Germany Utility Model Number 9209764, a tape with a row of sequins is sent out, and the leading sequin from the tape is cut and supplied to the sewing position of the embroidery machine. In Japanese Laid-Open Patent Publication Number 2-144094, during the sewing of the sequins, a needle bar hitter is removed from a needle bar by a jump solenoid, the upper thread is pulled by a lever, and the sequin is prevented from turning over during cloth feed.

During the process of sewing the sequin on, sometimes the sequin is dropped from the embroidery pattern due to the thread breaking or to malfunction of the supply device. In the prior art, with this situation, the embroidery pattern was mended by the same method used for normal stitches. In other words, the operator stops the embroidery machine when he realizes the thread breakage or supply failure, and press the mending switch on the machine head to reverse the embroidery frame one stitch at a time. After confirming the mending initiation position by eye and coordinating it with the needle drop position, the operator restarts the embroidery machine to sew the sequin onto the dropped part of the embroidery pattern.

According to the mending method of the prior art, however, because the embroidery frame is repositioned by the eye measurement, the sequin supply position when restarting the machine was often inaccurate. As a result, a sequin could be supplied on top of a prior sequin, or the spacing between the adjacent sequins could be too wide or too narrow, or the sewing line for the sequins could become uneven. The appearance of the embroidery pattern at the mending sites becomes poor.

The object of the present invention is to solve the above problems and to provide a method for attractively mending dropped parts of an embroidery pattern by supplying sequins to an accurate position when re-starting the machine.

SUMMARY OF THE INVENTION

In order to achieve the above object, a method for mending an embroidery pattern according to the present invention, when making an embroidery pattern distributed with sequins onto a cloth on the embroidery frame using an embroidery machine which controls the embroidery frame, the sequin supply device, and the needle bar based on sewing data, includes the following steps; determining if the sequin is dropped from the embroidery pattern, stopping the embroidery machine if the sequin is dropped, retrieving a control signal with a supply command for the sequin from the executed sewing data, returning an embroidery frame of the embroidery machine to a position indicated by a control signal one prior to the retrieved control signal, restarting the embroidery machine, and sewing a new sequin onto the dropped part of the embroidery pattern.

There are no particular limitations on the sewing data. For example, the data can be recorded on various recording medium, such as a punched tape, a magnetic disk (e.g. a flexible disk), an optical disk (e.g. a CD-ROM), or a semiconductor memory. The causes for dropping of sequins are not particularly limited, but examples include broken thread, using up of sequins, and malfunction of the sequin supply device. When a sequin is dropped, the embroidery machine is automatically stopped, or the operator manually stops the machine. In the former case, for example, a broken thread detector, or a counter for detecting the remaining sequins or detecting the number of sequins supplied can be used. In the latter case, examples of means for manual operation include a switch provided at hand of the control panel or the embroidery machine.

The control signal equipped with a sequin supply command is a signal which at least contains a command for operating the sequin supply device. For example, this can be a signal which is inserted in the sewing data and which only has the operating command for the supply device, or it can be a function code which is arrayed within the sewing data and which is a combination of an operating command for the supply device and position information of the embroidery frame and the needle drop command. The control signal one prior to this control signal is a signal which at least is equipped with position information of the embroidery frame. Stated more concretely, various types of signals depending on the sewing pattern for the sequin can be used, such as a function code combining the position information and a needle drop command, or a function code combining the position information and needle drop command and operation command for the supply device.

In the embodiment of the present method, when the operator conducts the mending operation once, the control signal with the most recent sequin supply command is retrieved from the executed sewing data. The embroidery frame is returned to a position indicated by the control signal one prior to this retrieved control signal. When the operator conducts the next operation for mending once, the control signal with the supply command for the next sequin is retrieved from the executed sewing data, and the embroidery frame is returned to a position specified by the control signal one signal prior to this signal. This retrieving and returning operation can be repeated until the position where the sequin is dropped is reached.

The operation for mending in this mode is not particularly limited to a particular operation. For example, it can be conducted by operating a mending switch. While the operation of the mending switch is continued for greater than a specified time (for example 3 seconds or longer), the embroidery frame is returned at high speed without stopping in between. In other words, the retrieval of the control signals is conducted one after another, and the embroidery frame is continually being returned one after another.

Prior to returning the embroidery frame or simultaneously with returning of the embroidery frame, the sequin supply device can be raised from an operating position to a resting position. By raising the sequin supply device, the area around the needle drop point is seen better, and it is easier to see which sequin the embroidery frame is being returned to. In addition, there is no danger of the sequin supply device being caught on a sewn sequin.

When returning the embroidery frame, the needle drop point can be lighted with a laser marker, or the needle can be lowered to near the needle drop point. By lighting the needle drop point or by lowering the needle to near the needle drop point, it is easier to see which sequin the embroidery frame has been returned to.

According to the method for mending an embroidery pattern of the present invention, when beginning mending, the embroidery frame is returned to a position indicated by a control signal which is one prior to the control signal with the sequin supply command. Thereupon, the embroidery machine is restarted at this position, and the sequin is supplied and sewed on. The supply starting point for the sequin is indicated by the control signal in the sewing data. As a result, the first sequin sewed on after restarting the machine correctly follows the sequin sewn on immediately before stopping the machine. Therefore, at the mending site, there is no overlapping of sequins and no unevenness in the line or pitch of the sequins, and the dropped part of the embroidery pattern is mended attractively.

DETAILED DESCRIPTION OF THE INVENTION

Figure 1:
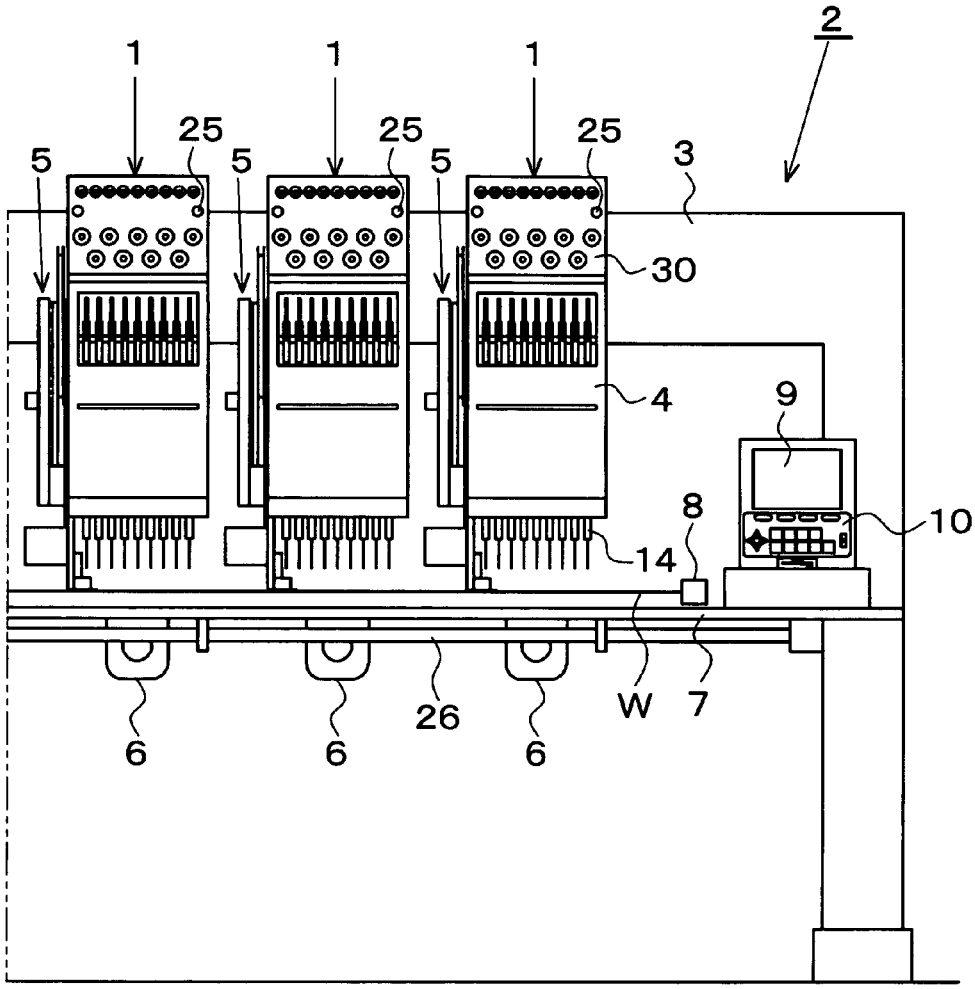
FIG. 1 is a front view of an embroidery machine of an embodiment of the present invention.

As shown in FIG. 1, based on a sewing data compiled in an operation panel 10, an embroidery machine 1 controls each of the drives for an embroidery frame 8, a sequin supply device 5, and a needle bar 14. An embroidery pattern distributed with sequins S is manufactured on a cloth W on the embroidery frame 8. Referring to FIGS. 5A to 5E, when a sequin S is dropped from the embroidery pattern during processing, the operator operates a start/stop switch 26. After stopping embroidery machine 1, a mending switch 25 is operated.

From the sewing data of previously executed, the control device of the embroidery machine 1 retrieves a control signal SJ which contains the sequin supply command. The embroidery frame 8 is returned to a position indicated by a control signal ST which is one signal prior to the signal SJ. The mending switch 25 is then operated once or several times. After positioning the supply start point for mending sequin S immediately after the sewed-on sequin S, the embroidery machine 1 is restarted, and the sequin S is sewn onto the dropped part of the embroidery pattern.

EXAMPLES

Referring to the figures, the embodiments of the present invention will be described. Referring to FIG. 1, a plurality of embroidery machines 1 of the present embodiment are arranged in a row on an apparatus frame 3 of a multi-head embroidery apparatus 2. A head 4 of each embroidery machine 1 is equipped with a sequin supply device 5. A bed 6 and a table 7 are placed under the head 4. An embroidery frame 8 for holding a cloth W is placed on top of the table 7. An operation panel 10 with a display part 9 is installed on one end of the table 7.

Figure 2:
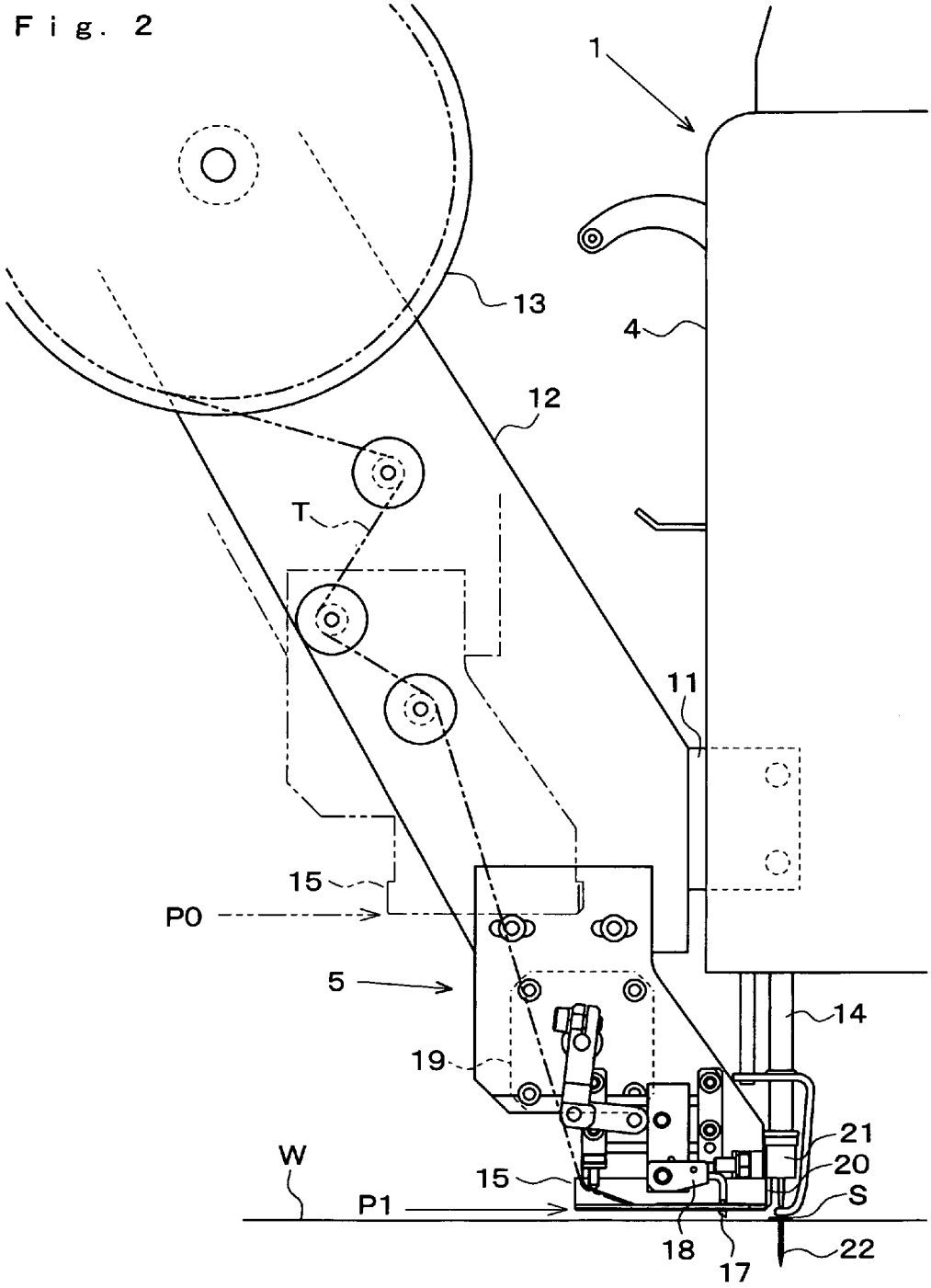
FIG. 2 is a partially cut away side view of a sequin supply device of the present invention.

Referring to FIG. 2, there is a lifting and lowering plate 12 which slides diagonally up and down and which is supported on a frame 11 of the sequin supply device 5. To the upper end of the lifting and lowering plate 12, there is attached a reel 13 for housing a tape T which has a row of sequins. At the lower end of the lifting and lowering plate 12, there is disposed a supply mechanism 15 for supplying the tape T to below a needle bar 14 of the embroidery machine 1. The lifting and lowering plate 12 is driven by a lifting and lowering air cylinder 16 (see FIG. 3), and the supply mechanism 15 is placed at an operational position P1 which is close to the cloth W and at a resting position P0 which is at a distance from the cloth W.

The supply mechanism 15 is provided with a tape sending member 18 equipped with a pin 17 which engages with a hole h of a sequin S (see FIG. 4), a tape sending motor 19 which drives the tape sending member 18, and a cutter 20 which cuts the tape T. While the supply mechanism 15 is positioned at the operational position, the tape sending member 18 is driven back and forth by the tape sending motor 19. When the needle bar 14 is lowered, the cutter 20 is lowered by a needle stop 21, the leading sequin S is cut from the tape T, and the sequin S is sewn onto the cloth W by a needle 22.

Figure 3:
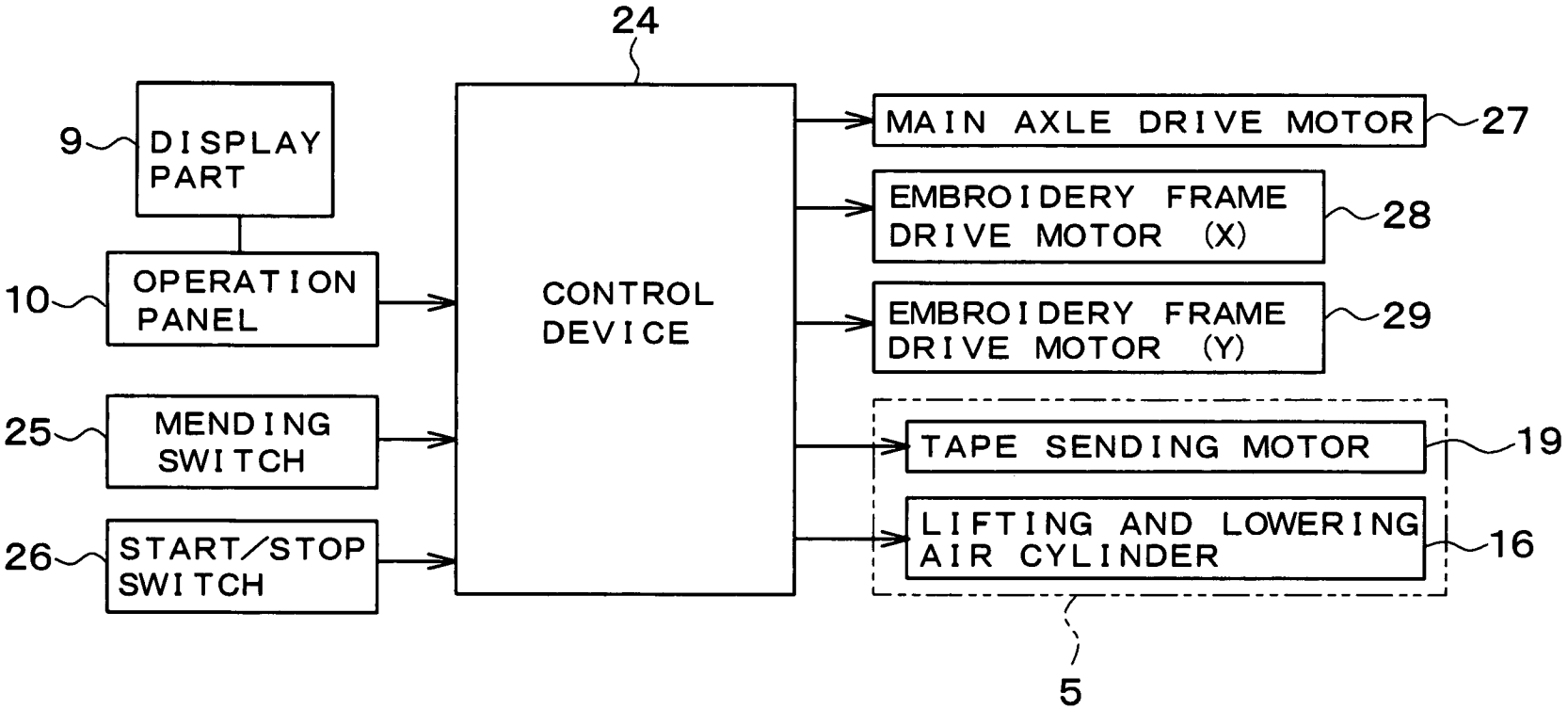
FIG. 3 is a block diagram showing a control system of the embroidery machine of the present invention.

Referring to FIG. 3, on the input side, a control device 24 for the multi-head embroidery apparatus 2 is connected with the operation panel 10 which has the edit function of the sewing data, a mending switch 25 which returns the embroidery frame 8 when mending a stitch, a start/stop switch 26 which starts or stops all of embroidery machines 1 at once, and the like. On the output side, the control device 24 is connected with a motor 27 which drives the main axle of the machine, motors 28 and 29 which drives the embroidery frame in the X and Y direction, the tape sending motor 19 of the sequin supply device 5, the lifting and lowering air cylinder 16, and the like.

Based on sewing data compiled in operation panel 10, the embroidery machine 1 of this embodiment controls the embroidery frame 8, the sequin supply device 5, and the needle bar 14. The embroidery machine 1 produces an embroidery pattern distributed with sequins S on the cloth W on the embroidery frame 8. As shown in FIG. 1, the mending switch 25 is provided on a tension table 30 of each embroidery machine 1, and the start/stop switch 26 is provided extending underneath the table 7 so that the operator who is standing in front of the embroidery machine 1 can conduct operations at hand.

Figure 4A:
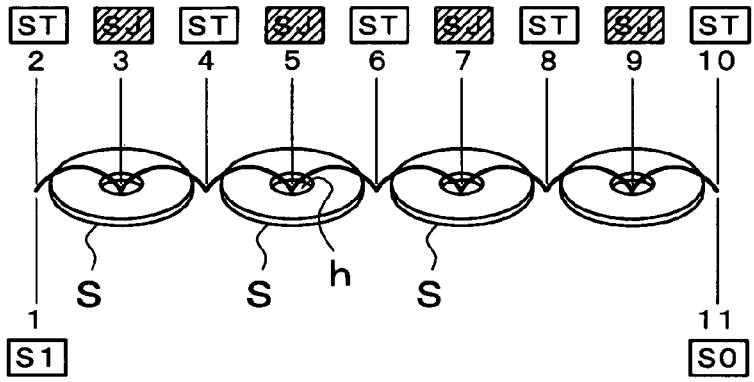
FIGS. 4A and 4B are schematic diagrams of an embroidery pattern showing the sewing pattern for sequins of the present invention.
Figure 4B:
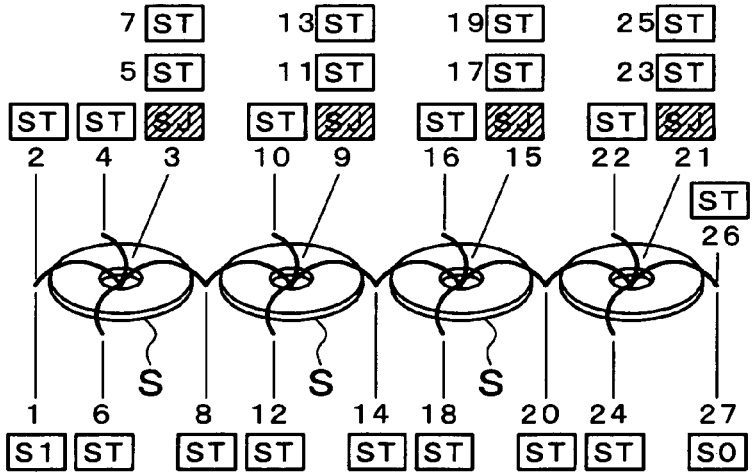

As shown in FIG. 4, the sewing data has several types of control signals S1, S0, SJ, ST. These are arranged according to the sewing pattern for the sequin S. FIGS. 4A and 4B have different sewing patterns. FIG. 4A shows a pattern example where each sequin is sewn on with two stitches. FIG. 4B shows a pattern example where each sequin is sewn on with four stitches. A initiation signal S1 has an energize command for the lifting and lowering air cylinder 16. In response to this signal S1, the supply mechanism 15 is lowered to the operational position P1. An end signal S0 has a de-energize command for the lifting and lowering air cylinder 16. In response to this signal S0, the supply mechanism 15 is raised to the resting position P0. In addition, during the control interval between the input of the initiation signal S1 and the input of the end signal S0, the control device 24 sets up a sequin sewing mode.

A jump signal SJ has a drive command for the tape sending motor 19, position information (XY-coordinates) for the embroidery frame 8, and a needle drop command. In response to the jump signal SJ, one sequin S is supplied, and a stitch for sewing the sequin on is formed. A stitch signal ST has positional information for the embroidery frame 8 and a needle drop command. In response to the signal ST, a stitch for sewing sequin S on is formed. As shown in FIGS. 4A and 4B, for each sequin sewing pattern, the sewing data always has one jump signal SJ.

Figure 5A:
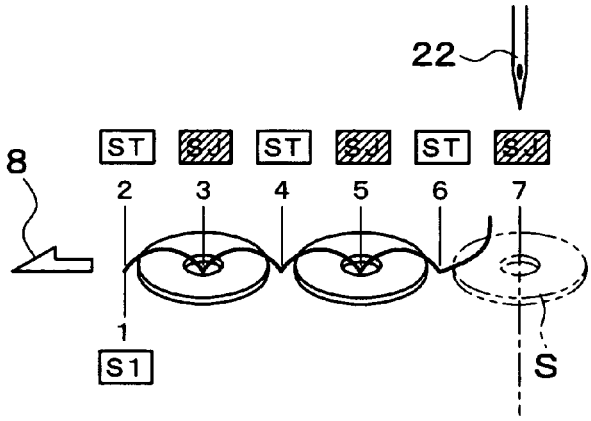
FIGS. 5A to 5E are schematic diagrams showing a mending method for an embroidery pattern of the present invention.

Next, with regard to the embroidery pattern with the sewing pattern shown in FIG. 4A, the mending method is described in accordance with FIGS. 5A–5E. In the sequin sewing mode, when a thread breakage occurs during processing of the embroidery pattern, subsequent sequins S are not sewn onto the cloth W, and due to vibrations or the like of the embroidery frame 8, the sequins are scattered and dropped from the embroidery pattern. FIG. 5A shows the condition when the sequin S supplied by the jump signal SJ of the seventh stitch is dropped from the embroidery pattern. The operator who notices this condition operates the start/stop switch 26 underneath the table 6 to the stop position, so that the embroidery machine 1 is stopped.

Figure 5B:
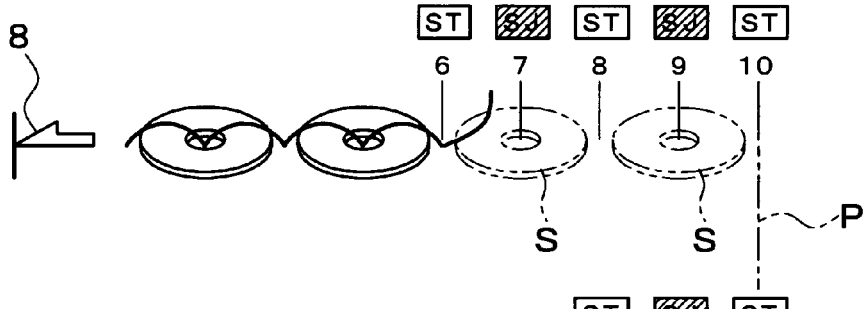

From the time of thread breakage until the time that embroidery machine 1 is completely stopped, the needle 22 moves up and down several times. Several sequins S are dropped, and the embroidery frame 8 is stopped after advancing for some time. In FIG. 5B, after thread breakage, the needle 22 moves up and down three times, and two sequins S are dropped. After executing the tenth stitch, embroidery frame 8 is stopped. If the embroidery machine 1 is equipped with a thread breakage detector, the embroidery machine 1 is automatically stopped in response to a thread breakage signal. However, even with this, several sequins S are dropped.

Figure 5C:
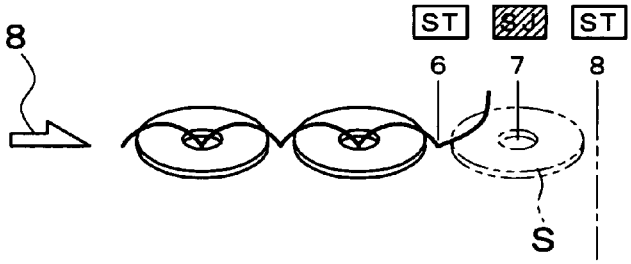

When the sequin S drops from the embroidery pattern, in order to mend the dropped part, the operator presses the mending switch 25 on the tension table 30 first. Thereupon, from the executed sewing data, the control device 24 retrieves the most recent jump signal SJ. Then, the control device 24 returns the embroidery frame 8 to a position indicated by the stitch signal ST that is one signal prior to the jump signal SJ. Referring to FIG. 5C, in response to the first operation of the mending switch 25, the jump signal SJ of the ninth stitch is retrieved, and the embroidery frame 8 is returned to a position indicated by the stitch signal ST of the eighth stitch.

Figure 5D:
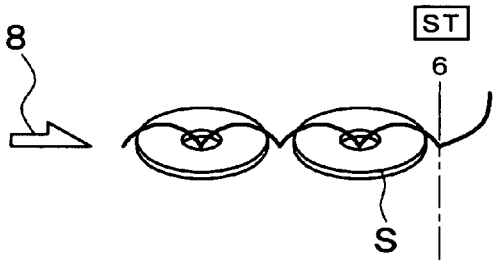

In this condition, however, there is still one more sequin S dropped before a needle pathway P. Therefore, the operator presses the mending switch 25 again. Thereupon, the control device 24 retrieves the next jump signal SJ from the executed sewing data, and returns the embroidery frame 8 to a position indicated by the stitch signal ST one prior to this jump signal SJ. Referring to FIG. 5D, in response to the second operation of the mending switch 25, the jump signal SJ of the seventh stitch is retrieved, and the embroidery frame is returned to a position indicated by the stitch signal ST of the sixth stitch.

Figure 5E:
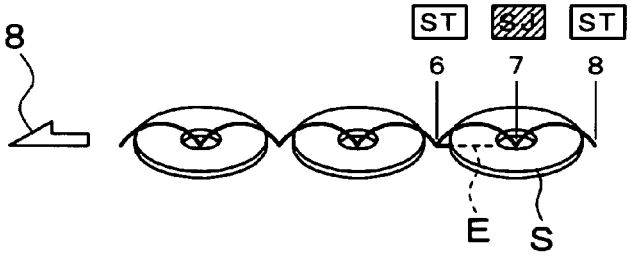

When the embroidery frame 8 is returned to this position, there is a sewn-on sequin S right before the needle pathway P. The operator confirms this and operates the start/stop switch 26 to the start position. The embroidery machine 1 is restarted. The sequin S is supplied by the jump signal S3 immediately after restarting, and is sewn onto the dropped part of the embroidery pattern. Referring to FIG. 5E, the thread breakage end B is covered and hidden by the sequin S supplied by the jump signal 53 of the seventh stitch, and the sequin S is sewn on by the stitch signal ST of the eighth stitch. From this point forward, the sewing is continued to complete the desired embroidery pattern distributed with sequins.

When the discovery of the thread breakage is delayed and numerous sequins S are dropped off consecutively, the operator continually presses the mending switch 25, so that the embroidery frame 8 can be returned at a high speed without stopping. In other words, as long as the on-operation of the mending switch 25 is being continued, the retrieval of the jump signal SJ is conducted continually, and the return of the embroidery frame is conducted continually. When the mending switch 25 is pushed in the normal sewing mode, the embroidery frame 8 is returned one stitch at a time, and when the mending switch 25 is pushed continually, the embroidery frame 8 is returned at a high speed. With an embroidery pattern with the sew-on pattern shown in FIG. 4B, for example, when the embroidery frame 8 is stopped at the twentieth stitch after thread breakage, by pushing the mending switch 25 once, the embroidery frame 8 is returned to a position indicated by the stitch signal ST of the fourteenth switch. By pushing the mending switch 25 two times, the embroidery frame 8 is returned to a position indicated by the stitch signal ST of the eighth stitch.

Therefore, according to the mending method of this embodiment, with any kind of sequin sewing pattern, regardless of where there is a thread breakage, and regardless of where the embroidery frame 8 is stopped, by pressing the mending switch 25, the embroidery frame 8 is always returned to the supply start point for the sequin S. Because the supply start point is the needle drop point indicated by the stitch signal ST in the sewing data, the first sequin S sewn after restarting the machine correctly follows the previously sewn sequin S. As a result, at the mending site, the thread breakage end E is hidden, and overlapping of sequins S and unevenness in pitch or line are prevented. The dropped part of the embroidery pattern is mended attractively. In addition, because embroidery frame 8 only stops at indicated points and passes through needle drop points that are not indicated, with patterns with dense needle drop points such as shown in FIG. 4B, the number of times the mending switch 25 is operated is reduced, and the mending operation can be conducted more easily.

The present invention is not limited to the above embodiments. As shown by the following examples, various changes can be made without departing from the scope or spirit of the invention.

In one embodiment, the start/stop switch 26 is also used as the mending switch. Thus, the control circuit is constructed so that when the embroidery machine 1 is stopped, if start/stop switch 26 is further operated to the stop side, the embroidery frame 8 is returned.

In another embodiment, a mending switch used exclusively for the sequin sewing which is separate from a mending switch used for normal sewing is provided on sequin supply device 5, for example.

In still another embodiment, two sequin supply devices 5 are attached to the left and right side of the embroidery machine 1. By alternating the operation the left and right supply mechanisms 15, embroidery patterns distributed with sequins of differing sizes can be produced by a single embroidery machine 1.

In an alternate embodiment, after the embroidery machine is stopped and the mending switch 25 is pushed, and before or simultaneous with the return of the embroidery frame 8, the sequin supply device 5 is raised from the operational position P1 to the resting position P0.

Figure 6A:
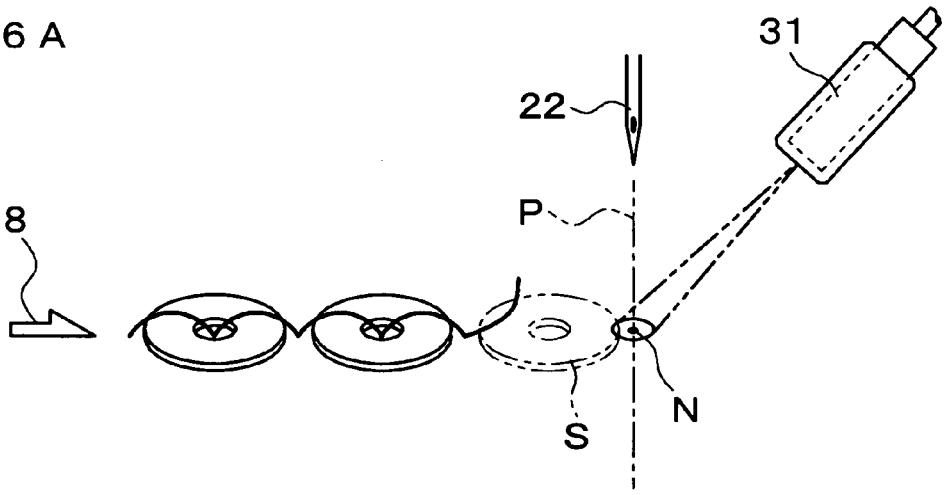
FIGS. 6A and 6B are schematic diagrams showing the area around the needle when returning the embroidery frame.
Figure 6B:
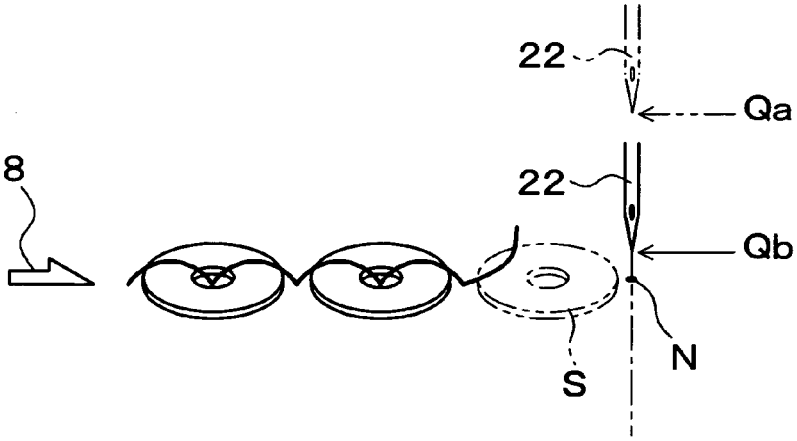

In further embodiments, as shown in FIG. 6A, when returning the embroidery frame 8, a needle drop point N on the cloth W is lighted with a laser marker 31, or as shown in FIG. 6B, when returning the embroidery frame 8, the needle 22 is lowered from the normal raised position Qa (top dead point or the like) to a near position Qb which is near the needle drop point N on the cloth W.

What is claimed is:

1. A method for mending an embroidery pattern sewn on an embroidery machine controlled based on a sewing data, comprising the steps of:

determining if a sequin is dropped from the embroidery pattern;

if said sequin is dropped, stopping the embroidery machine;

retrieving a control signal with a supply command for said sequin from executed sewing data;

returning an embroidery frame of the embroidery machine to a position indicated by a control signal one prior to said retrieved control signal;

restarting the embroidery machine; and sewing a new sequin onto said dropped part of the embroidery pattern.

2. The mending method as described in claim 1, further comprising the step of repeating said retrieving and returning steps until a dropped sequin position of said dropped sequin is reached.

3. The mending method as described in claim 2, wherein said repeating step includes operating a mending switch.

4. The mending method as described in claim 3, further comprising the steps of continuously operating said mending switch; and returning said embroidery frame at high speed without stopping while continuously operating said mending switch.

5. The mending method as described in claim 1, further comprising the step of raising a sequin supply device from an operational position to a resting position one of before and simultaneous with said returning step.

6. The mending method as described in claim 1, wherein said returning step comprises the step of lighting a needle drop point with a laser marker.

7. The mending method as described in claim 1, wherein said returning step comprises the step of lowering a needle approximate to a needle drop point.

8. A method for mending an embroidery pattern sewn on an embroidery machine controlled based on sewing data, comprising the steps of:

performing a first mending operation comprising the steps of:

determining if a sequin is dropped from the embroidery pattern;

if said sequin is dropped, stopping the embroidery machine;

retrieving a first control signal with a supply command for a most recent sequin from executed sewing data; and returning an embroidery frame of the embroidery machine to a first position indicated by a control signal one prior to said retrieved first control signal;

performing a second mending operation comprising the steps of:

retrieving a second control signal with a supply command for a second sequin previous to the most recent sequin from the executed sewing data; and returning the embroidery frame of the embroidery machine to a second position indicated by a control signal one prior to said retrieved second control signal;

repeating the second mending operation until a dropped sequin position of said dropped sequin is reached;

restarting said embroidery machine; and sewing a new sequin onto said dropped part of the embroidery pattern.

9. The mending method as described in claim 8, wherein said mending operations include operating a mending switch.

10. The mending method as described in claim 9, further comprising the step of:

continuously operating said mending switch; and returning said embroidery frame at high speed without stopping while continuously operating said mending switch.

* * * * *